United States Patent [19]

Eriksson et al.

[11] Patent Number: 4,782,637

[45] Date of Patent: Nov. 8, 1988

[54] FRAME STRUCTURE

[75] Inventors: Arne Eriksson; Weine Hammarberg; Kurt Pettersson, all of Enköping, Sweden

[73] Assignee: AB Bahco Ventilation, Enköping, Sweden

[21] Appl. No.: 32,342

[22] Filed: Mar. 31, 1987

[30] Foreign Application Priority Data

Apr. 7, 1986 [SE] Sweden ..... 8601549

[51] Int. Cl.[4] ..... E04B 1/38; F16B 12/20

[52] U.S. Cl. ..... 52/280; 52/648; 312/111; 312/263; 312/257 SM; 403/172; 403/176

[58] Field of Search ..... 52/280, 648; 211/182; 403/172, 176, 295, 297; 312/111, 263, 257 SM, 257 SK

[56] References Cited

U.S. PATENT DOCUMENTS

| | | | |
|---|---|---|---|
| 2,364,083 | 12/1944 | Lindsay | 52/280 |
| 3,272,582 | 9/1966 | Anderson et al. | 403/172 |
| 3,353,854 | 11/1967 | Hansen | 52/474 |

FOREIGN PATENT DOCUMENTS

| | | | |
|---|---|---|---|
| 1580999 | 9/1969 | France | 211/182 |
| 396345 | 1/1966 | Switzerland | 211/182 |
| 2040386 | 8/1980 | United Kingdom | 403/295 |

*Primary Examiner*—James L. Ridgill, Jr.

[57] ABSTRACT

A frame structure for the construction of a box-shaped casing, in particular for air treatment devices. The frame structure comprises straight profile members (22), on the one hand, and corner elements (50,52) with three mutually perpendicular protrusions, each being connectable to one of said profile elements, on the other hand. Each corner element consists of two parts, namely an external part (50) including the external portions (**50*a*, 50*b*,50*c*) of said protrusions and an internal part (52) including the internal portions (52*a*,52*b*,52*c*) of the protrusions. Said protrusion portions together form a closed cross-section fitting internally into the likewise closed cross-section of the profile members (b 22). The profile members can be slid onto the corner element protrusions while simultaneously securing the external and internal corner element parts (50,52**).

9 Claims, 3 Drawing Sheets

FRAME STRUCTURE

The invention relates to a frame structure for the construction of a box-shaped casing for one or more air-treatment devices, such as fans, air filters, air humidifiers, heating or cooling apparatus, heat exchangers etc. The frame structure comprises straight profile members, on the one hand, and corner elements with three mutually perpendicular protrusions each being connectable to one of said profile members, on the other hand.

Such a frame structure, consisting of sheet metal parts, is known from, e.g., SE-B- No. 7609128-9. The coupling between the corner element protrusions and the profile members is effected by means of screw fasteners, and consequently, when constructing a frame structure consisting of twelve profile members and eight corner elements, a plurality of screws must be tightened (at least 24 screws, since every corner element must be fastened with at least three screws). Moreover, differently profiled members are used as well as different corner elements adjusted to the different profile members, which makes the manufacture and construction even more complicated.

The object of the present invention is to simplify the manufacture and construction of such a frame structure. Moreover, upon mounting wall elements and possible shutters to form a complete casing, the frame structure should be as tight as possible as well as heat and sound insulating.

These objects are achieved by the invention in that every corner element consists of two parts (each of which is quite simple to manufacture by punching and bending of sheet metal pieces), namely an external part including the external portions of the corner element protrusions and an internal part including the internal portions of the corner element protrusions, which external and internal protrusion portions together form a substantially closed cross-section, and in that the profile members have closed (preferably mutually alike) cross-sections and are slidable externally onto the respective corner element protrusion while simultaneously securing the external and internal parts of the corner elements. Thus, a positive locking of the corner element parts is achieved in that, in the area of each protrusion, they are enclosed by a profile member and are thus locked against any displacement in all directions being perpendicular to this particular profile member. Since the three protrusions are mutually perpendicular, the locking is effective in all the directions.

Owing to the fact that each corner element is divided into two parts, which may be completely loose or coupled together in a simple manner, the manufacture of the corner elements is considerably facilitated, and the necessary securing of the two parts is automatically achieved when the frame structure is being mounted. Because of the closed cross sections of both the corner elements (in mounted condition) and the profile members, the frame structure becomes sound and heat insulating.

By forming snap locking means on the corner elements and on the profile members, the frame structure can be mounted without either welding joints or special fasteners, such as screws or the like. Such snap locking means should preferably comprise complementarily formed material portions of the internal sides of the profile members and the internal part of each corner element, whereby the external side of the erected frame structure remains completely smooth.

Of course, it is also possible to make the internal part of the corner element snappable onto the external portion.

Additional features and advantages of the invention will appear from the following description, in which reference is made to the appended drawings.

Figure 1:
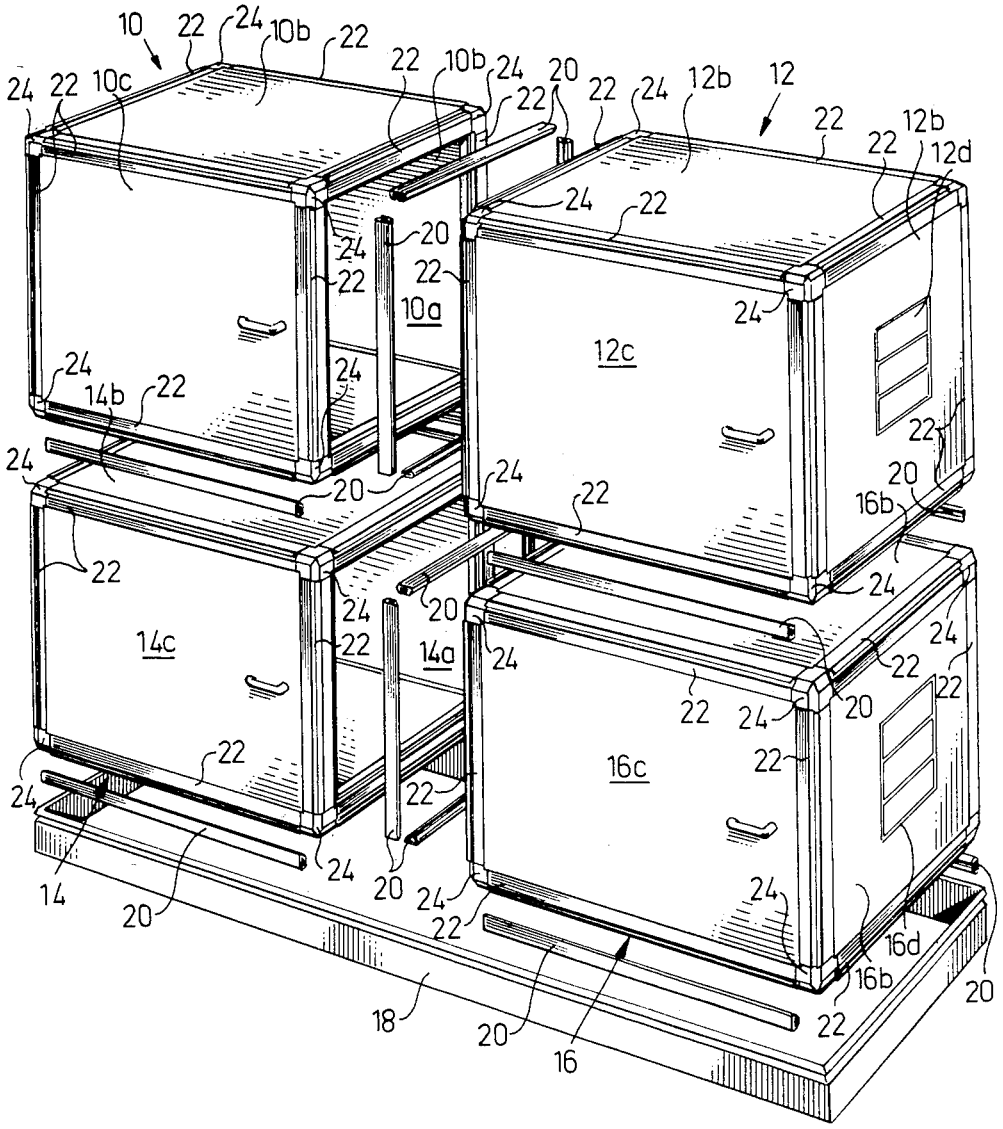
FIG. 1 shows in perspective view four casings formed by a frame structure according to the invention as well as wall elements and shutters.

FIG. 1 illustrates how four apparatus casings 10,12,14,16 may be mounted on a bottom frame 18 and be mutually connected by means of guide engagement rods 20, which engage with the adjoining frame portions by means of guide flanges. Each casing consists of twelve straight profile members 22 and eight corner elements as well as stationary wall elements **10*b*, 12*b*, 14*b*, 16*b* and openable shutters 10*c*, 12*c*, 14*c*, 16*c*. At the ends of the casing, the wall elements have connection openings provided with dampers (only 12*d* and 16*d* can be seen in FIG. 1) to be connected to air ducts (not shown), e.g. for intake air and exhaust air. The arrangement according to FIG. 1 is only meant to be a schematic example. In practice, an air treatment assembly can be built by a plurality of components in different ways, and the number of apparatus casings and their mutual locations can differ in many ways both horizontally and vertically. In FIG. 1, the upper apparatus casings 10, 12 are mutually connected in that the adjoining sides are open and form flow passages 10*a*, 12*a*. In a correpsonding manner, the lower casings 14, 16 communicate through openings 14*a*, 16*a*** inside each frame portion.

Figure 2:
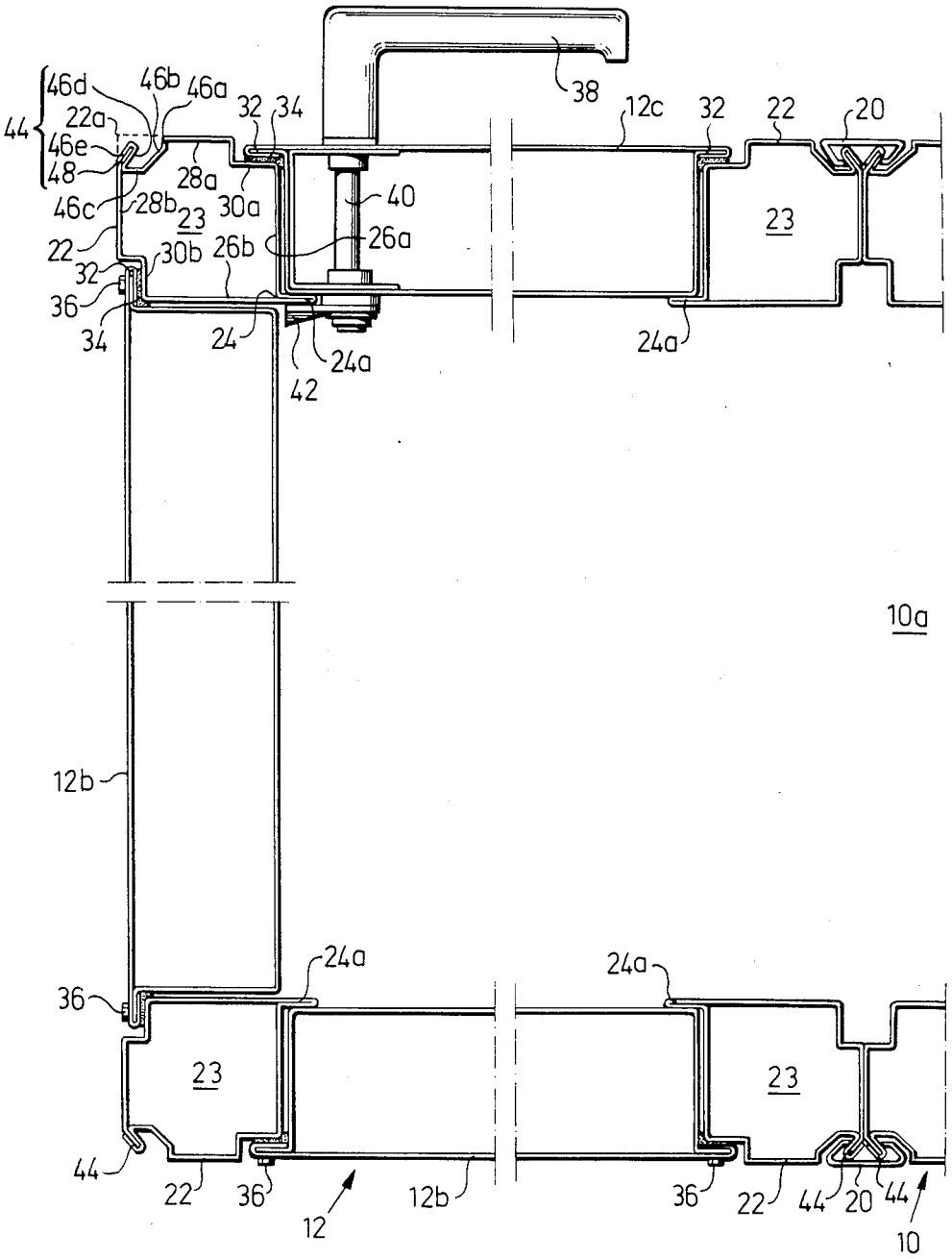
FIG. 2 shows a horisontal section through a casing and a portion of another casing according to FIG. 1 coupled thereto.

The connection between the casings 10 and 12 appear also from the horizontal section (turned 180° in relation to FIG. 1) shown in FIG. 2, wherein the coupling by means of a guide engagement rod 20 and the guide flanges 44 of the adjoining profile members are shown to the right. Furthermore, it is shown how the stationary wall elements **12*b* are fastened by means of screws 36 and how an openable front shutter 12*c* is lockable by means of a handle 31, which, via a through-going shaft 40, is connected to a pivotable lock bolt 42, which cooperates with an internal flange 24*a* on the profile member 22. The wall elements 12*b* and the shutter 12*c* have an external, circumferential flange 32, which fits into a seat in the form of a step-like shoulder 30*a*, 30*b* at the transition portion between the internal sides 26*a*, 26*b* of the profile member and its external sides 28*a*, 28*b*. A sealing strip 34 is provided between the flange 32 and the shoulders 30*a* and 30*b*, respectively, (at the inside of the flange 32**).

The external side **28*a* of the profile member 22 extends into bent portions 46*a*, 46*b*, 46*c*, 46*d*, 46*e*, which form a recessed external corner portion and a fold around the end portion 48 of the other external side 28*b* so as to form the guide flange 44**.

Figure 3:
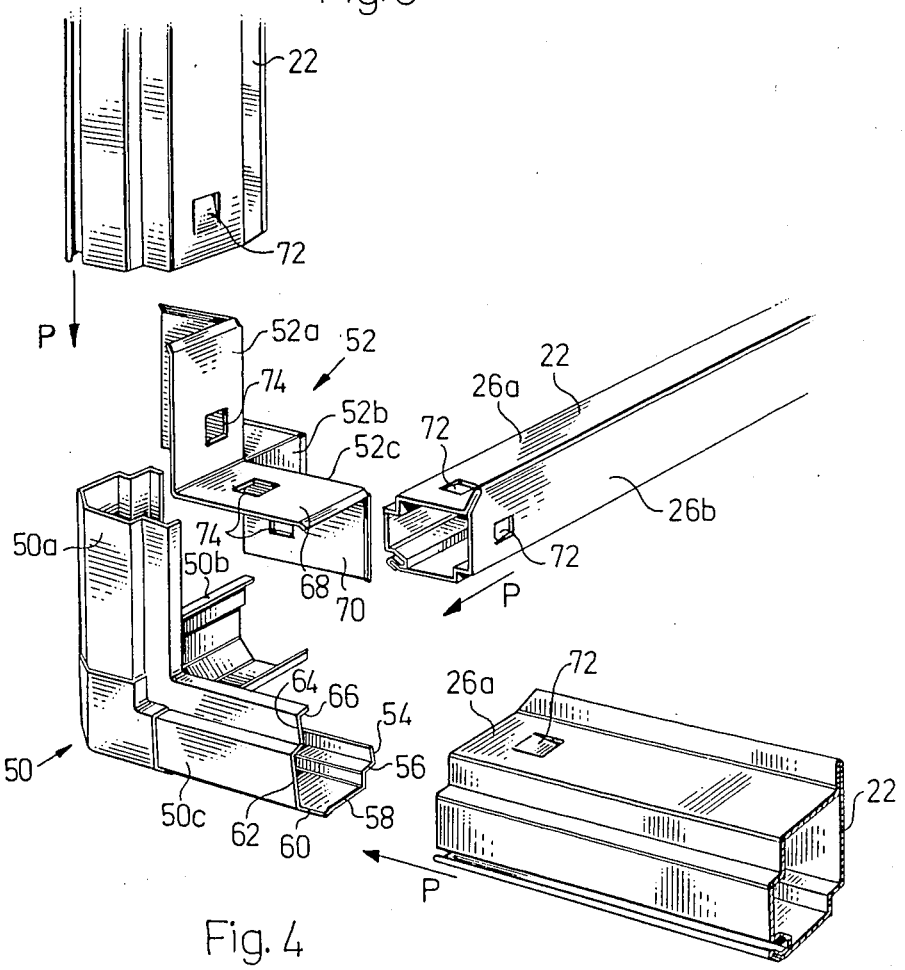
FIG. 3 shows in perspective view how three profile members can be coupled to a corner element divided into two parts.

FIG. 3 shows how three profile members 22 may be connected to a corner element consisting of two parts 50,52.

The corner element parts 50,52 are made by punching and bending of metal pieces (the profile members 22, on the other hand, are made by rolling) and have open cross-sections, which upon assembly form a closed cross-section coresponding to the interior cross-sectional outline of the profile member 22, at each one of three mutually perpendicular protrusions 50*a*, 52*a*, 50*b*, 52*b* and 50*c*, 52*c*. Thus, each protrusion of the external corner element part 50 is provided with wall portions 54,56,58,60,62,64,66 corresponding to the internal side 26*b* (partly) of the profile member, the shoulder 30*b*, the external side 28*b*, the recessed corner portion 46*b*, the external side 28*a*, the shoulder 30*a* and the internal side 26*a* (partly), whereas the protrusion of the internal part 52 is essentially L-shaped in correspondence with the internal sides 26*a*, 26*b* of the profile member 22. Both legs 68,70 of the internal corner element part 52 are laid onto the external side of the flange-like wall portions 66 and 54 respectively, whereafter the profile members 22 can be externally slid onto the respective protrusions (see arrows P). In its slid-on position, the profile member 22 is locked to the associated protrusion by snap-locking interaction between punched, inwardly directed tabs 72 in the internal sides 26*a*, 26*b* of the profile member and corresponding, punched holes 74 in the protrusion legs 68,70 of the internal corner element part 52. Upon sliding on two profile members 22, the internal corner element part 52 is fixed to the external corner element part 50, and upon sliding on a third profile member, the locking effect is further improved. It is obvious that the manufacture (by means of stamping and bending of each corner element part) and the mounting (by means of sliding the profile members onto the protrustions of the assembled corner element parts) is hereby extremely simple, since neither welding nor screws are needed. Moreover, in this manner, one obtains a closed cross-section in the whole frame structure, including the corners thereof, so that the frame structure becomes tight as well as heat and sound insulating.

Figure 4:
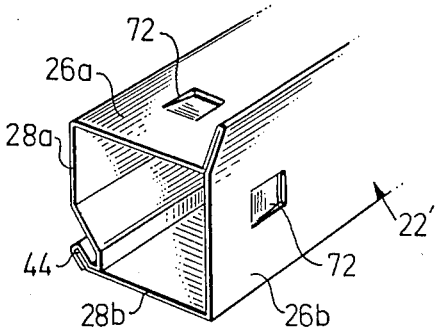
FIG. 4 shows a simplified embodiment of a profile member.

The cross-sectional shape of the profile members 22 and the corner element protrusions 50*a*,52*a*; 50*b*,52*b*; 50*c*,52*c* is not essential to the inventive concept, and those skilled in the art can alter the closed cross-section in different ways within the scope of claim 1. A modification close at hand is shown in FIG. 4, in which the profile member 22' does not have any shoulders 30*a*, 30*b* (see also FIG. 2). The wall portion 46*a* has been omitted as well.

The inventive concept can be used for other purposes than casings for air treatment devices, and materials other than metal can be used, such as extruded profile members and injection moulded corner element parts of thermoplastic material.

We claim:

1. A corner frame structure of a casing, consisting of: a single corner element having three mutually perpendicular identical protrusions, each protrusion having a substantially closed, longitudinally constant cross section and consisting of an external and internal part of said corner element; and three straight profile members, each profile member having a substantially closed longitudinally constant cross section snugly externally fitted onto the respective protrusion to thereby secure the external and internal parts to each other.

2. A frame structure according to claim 1, wherein the internal part partially overlaps the external part.

3. A frame structure according to claim 1, wherein each internal part has an essentialy L-shaped cross-section.

4. A frame structure according to claim 1, wherein complementarily formed portions of the profile members and the internal part of the corner element form snap-locking means securing the respective profile member to the corner element.

5. A frame structure according to claim 1, wherein the profile members have a substantially square cross-section.

6. A frame structure according to claim 1, wherein each profile member has a flange at an external corner edge, said flange serving as a guide means for a guide engagement rod for coupling the frame structure to another frame structure of the casing.

7. A frame structure according to claim 1, wherein each profile member has a step-like shoulder for receiving a flange of a wall element of the casing.

8. A frame structure according to claim 1, wherein said profile members and said corner element consist of metal.

9. A frame structure according to claim 8, wherein each profile member is a rolled integral piece, and the corner element parts are bent metal pieces

* * * * *

UNITED STATES PATENT AND TRADEMARK OFFICE

CERTIFICATE OF CORRECTION

PATENT NO. : 4,782,637

DATED : November 8, 1988

INVENTOR(S) : Arne Eriksson, et al

It is certified that error appears in the above-identified patent and that said Letters Patent is hereby corrected as shown below:

Title page, Inventors:

[75] Arne Eriksson; Weine Hammarberg; Kurt Pettersson; Odd Strand, all of Enköping, Sweden Signed and Sealed this Twentieth Day of March, 1990

*Attest:*

*Attesting Officer*

JEFFREY M. SAMUELS

*Acting Commissioner of Patents and Trademarks*